US006481803B2

(12) United States Patent
Ritchey

(10) Patent No.: US 6,481,803 B2
(45) Date of Patent: Nov. 19, 2002

(54) UNIVERSAL BIT HOLDER BLOCK CONNECTION SURFACE

(75) Inventor: Cary D. Ritchey, Curryville, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/761,372

(22) Filed: Jan. 16, 2001

(65) Prior Publication Data

US 2002/0093240 A1 Jul. 18, 2002

(51) Int. Cl.[7] ..... E21C 35/19

(52) U.S. Cl. ..... 299/79.1; 299/102; 299/106; 299/108; 299/82.1

(58) Field of Search ..... 299/79.1, 102, 299/108, 106, 107, 82.1

(56) References Cited

U.S. PATENT DOCUMENTS

| | | | | |
|---|---|---|---|---|
| 2,411,170 A | | 11/1946 | Simmons | 262/33 |
| 3,751,115 A | * | 8/1973 | Proctor | 299/109 |
| 4,068,897 A | | 1/1978 | Amoroso | 299/91 |
| 4,240,669 A | | 12/1980 | Rollins | 299/86 |
| 4,337,980 A | | 7/1982 | Krekeler | 299/91 |
| 4,542,943 A | * | 9/1985 | Montgomery, Jr. | 299/102 |
| 4,728,153 A | | 3/1988 | Ojanen et al. | 299/92 |
| 4,783,030 A | * | 11/1988 | Buerhop | 248/49 |
| 5,261,499 A | * | 11/1993 | Grubb | 299/107 |
| 5,647,642 A | | 7/1997 | Word | 301/5.21 |
| 6,183,170 B1 | * | 2/2001 | Wald et al. | 299/109 |

FOREIGN PATENT DOCUMENTS

| | | |
|---|---|---|
| FR | 1470059 | 2/1967 |
| GB | 1044926 | 10/1966 |
| GB | 1110495 | 4/1968 |
| SU | 1776786 | 11/1992 |
| WO | WO9945238 | 9/1999 |

OTHER PUBLICATIONS

Brochure Kennametal Mining Products, 1996—Kennametal Inc., Latrobe, Pennsylvania.

Brochure CARMET Minetools, Carbide Construction Tools, undated.

Catalog Hughes MPD, Construction Tools, Catalog No. MPD–3, Effective Mar. 1, 1984.

Catalog Kennametal Construction Tooling Systems, 1985—Kennametal Inc. Latrobe, Pennsylvania B84–178(10)A5.

* cited by examiner

*Primary Examiner*—David Bagnell
*Assistant Examiner*—John Kreck
(74) *Attorney, Agent, or Firm*—Kevin P. Weldon

(57) ABSTRACT

According to the present invention a bit holder block that can be durably connected to both a driven chain and rotary drum is disclosed. The bit holder block is designed to enable it to be welded or fused by other well-known methods to either a rotary drum or driven chain. The invention includes a bottom surface for welding to either a drum or chain. The bottom surface includes a central arcuate surface and flanking flat surfaces at opposite ends of the central arcuate surface. On the flat plate of driven chain cutting machinery the flanking flat surfaces sit squarely on the flat plate. When welded to a drum the base's bottom surface makes two lines of contact with the drum limiting the likelihood of undesirable.

12 Claims, 6 Drawing Sheets

UNIVERSAL BIT HOLDER BLOCK CONNECTION SURFACE

FIELD OF THE INVENTION

The invention relates to fixing a cutting tool assembly to cutting tool machinery.

BACKGROUND OF THE INVENTION

This invention is related to the field of earth working bit tools such as those used on machines for cutting rock or coal or machines for road building and road maintenance. The driven cutting tools are driven on machines to dislodge the bedded materials. In mining machines such as continues miners, road working machines like road planers and earth moving machines such as mechanized shovels a plurality of cutting bits are mounted on these apparatus for cutting earth strata or man made surfaces such as asphalt, pavement or concrete. The bits are moved by moving means such as a rotating wheel, chain, rotating arm or rotating drum. Mining machines themselves are of various types including undercutting machines, continues mining machines and long wall mining machines. The bits generally include a bit holder block for holding the cutting tool. The bit tools are mounted on a bit holder blocks that can be directly connected to the driven mining/construction machinery. The bit holder blocks are subject to wear and must be periodically replaced. The bit holder blocks on mining machinery and construction equipment are directly welded onto said machinery and equipment.

The cutting bit tools during operation are subjected to large loads. The large load may be the result of the cutting bit coming into contact with an underground obstacle like a manhole cover, bridge expansion joint or rail in construction or a pure grade ore such as copper in mining. The bit holder support block may be knocked off from the cutting machinery if the weld is not sufficiently strong.

Cutting tool bits in both the mining and construction industries have head tips made from cemented tungsten carbide and are generally conical in shape. In both industries the cutting bit tools are mounted on driven chains or rotary drums. The loads on both chains and drum type cutting tools are large and requires that the bit holder block be durably connected to the driven machinery.

U.S. Pat. Nos. 4,728,153 and 5,647,642 illustrate cutting tool assemblies in which the bit holder block is welded onto a rotary drum.

UK patent 1,044,926 discloses a first bit holder block that is welded to a rotary drum shown in FIG. 6 wherein the bottom contact surface of the bit holder block is correspondingly curved to permit it to be welded onto curved driven machinery. In FIG. 17 of UK 1,044,926 a bit holder block is shown having a flat contact surface for being welded onto a chain drive flat plate.

Construction companies and mining companies that operate both rotary drum and chain driven cutting equipment must maintain separate inventories of bit holder blocks for both chain driven equipment and rotary drums.

There is a need in the industry for a universal bit holder block that can be adequately welded onto a chain or rotary drum to withstand large loads and torques.

SUMMARY OF THE INVENTION

According to the present invention a bit holder block that can be durably connected to both a driven chain and rotary drum is disclosed. The bit holder block is designed to enable it to be welded to either a rotary drum or driven chain so as to withstand large loads that occur in mining and construction.

Two coplanar flat surfaces on opposite sides of a central curved section provide for easy welding to chains and provide for effective two line contact mounting on a drum for welding.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
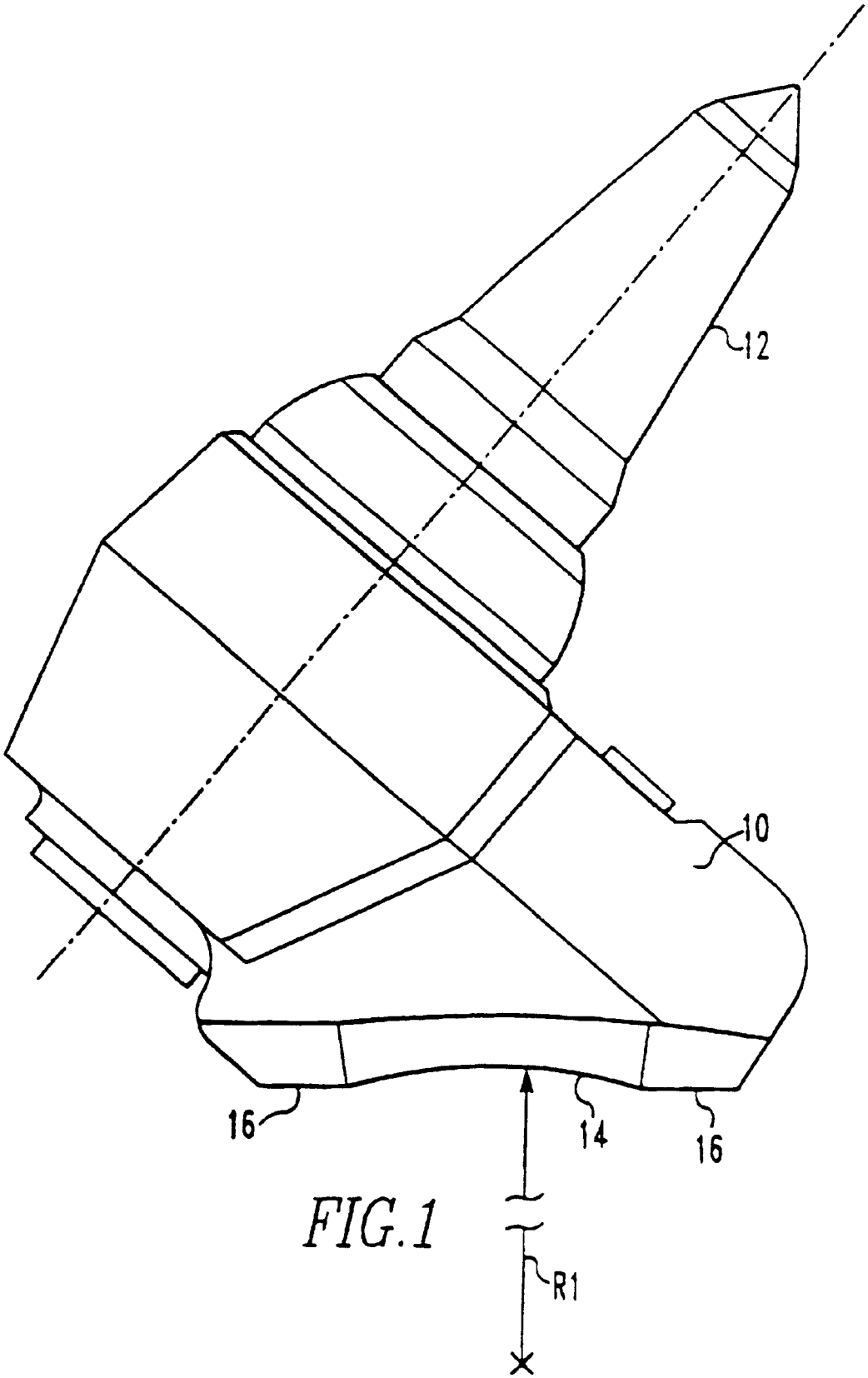
FIG. 1 discloses a side view of a first embodiment of the cutting tool assembly invention.
Figure 2:
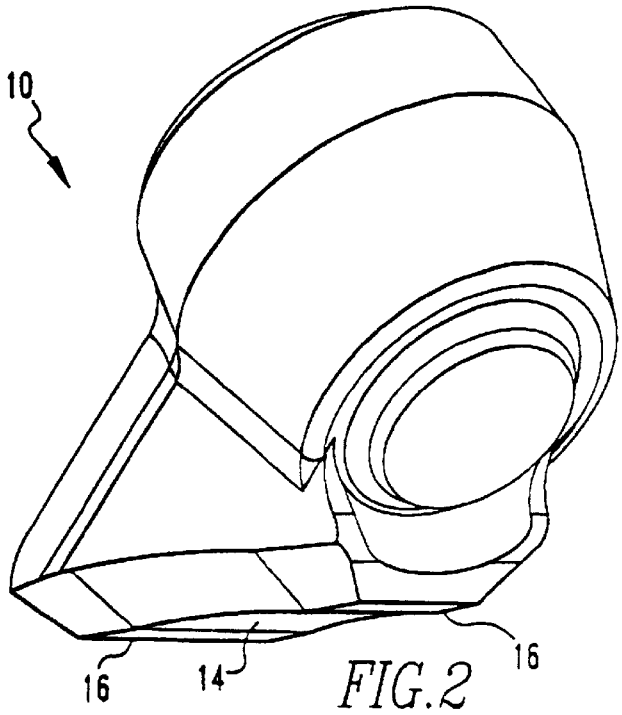
FIG. 2 discloses a rear perspective view of the bit holder block of the invention shown in FIG. 1.
Figure 3:
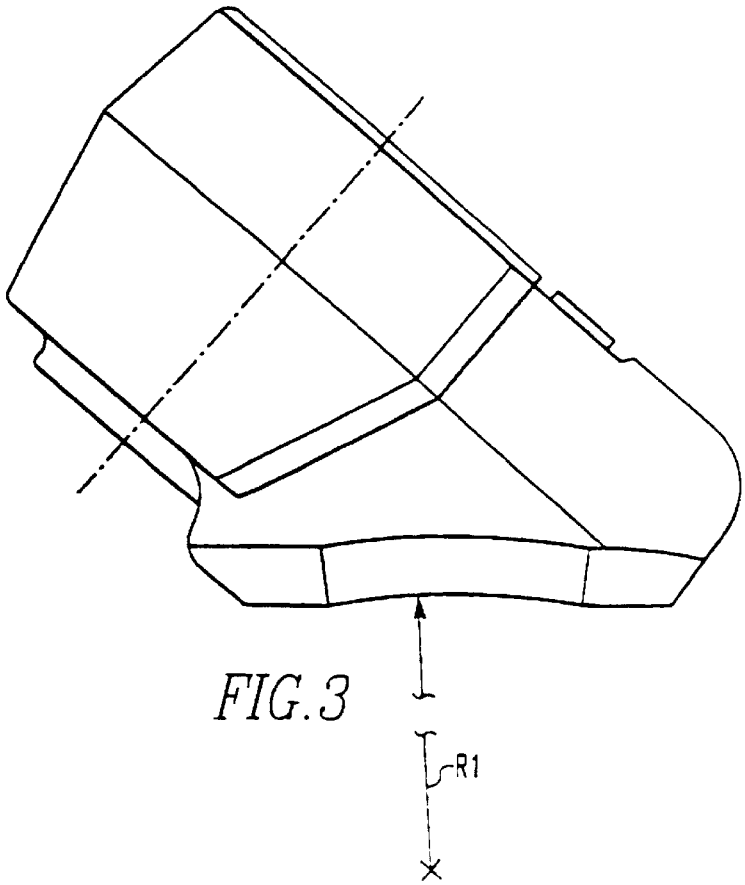
FIG. 3 illustrates a side view of the bit holder block of the invention shown in FIG. 1.

Referring to the drawing in more detail FIG. 1 shows applicant's bit holder block 10 and a cutting tool 12 mounted in the bit holder block. The bit holder block has a bottom surface that is welded onto a driven piece of mining or construction machinery. As seen in FIG. 1 the bottom surface includes a centrally curved center portion 14 and two flanking adjacent portions 16. Wherein the flanking adjacent portions are flat and coplanar and the centrally curved portion 16 has a radius of curvature R1.

Figure 4:
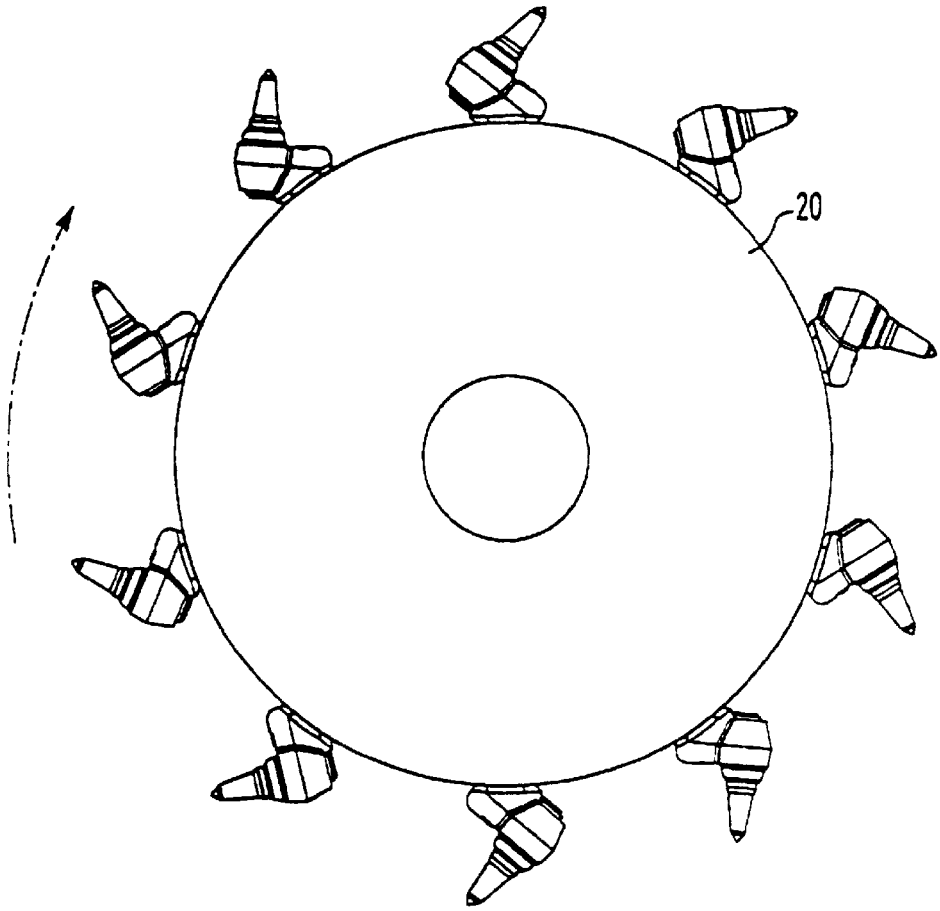
FIG. 4 illiterates the cutting tool assembly invention welded onto a rotary drum.
Figure 5:
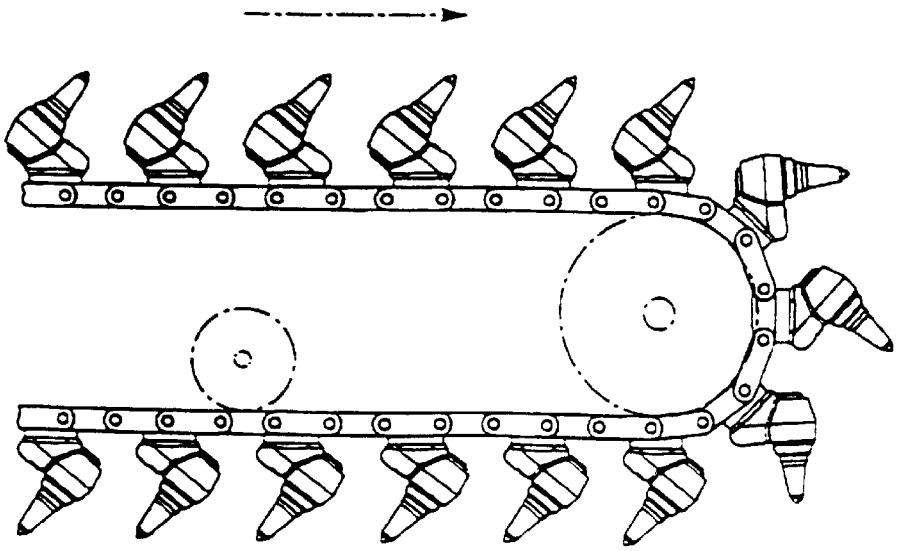
FIG. 5 illustrates the cutting tool assembly invention welded onto a driven chain.

The bit holder block in applicant's invention can be alternatively mounted to a rotary cutting drum as seen in FIG. 4 or a driven chain as shown in FIG. 5. The bit holder block is either welded to the chain or drum or connected to the chain or drum by some other well-known fusing means.

Figure 6:
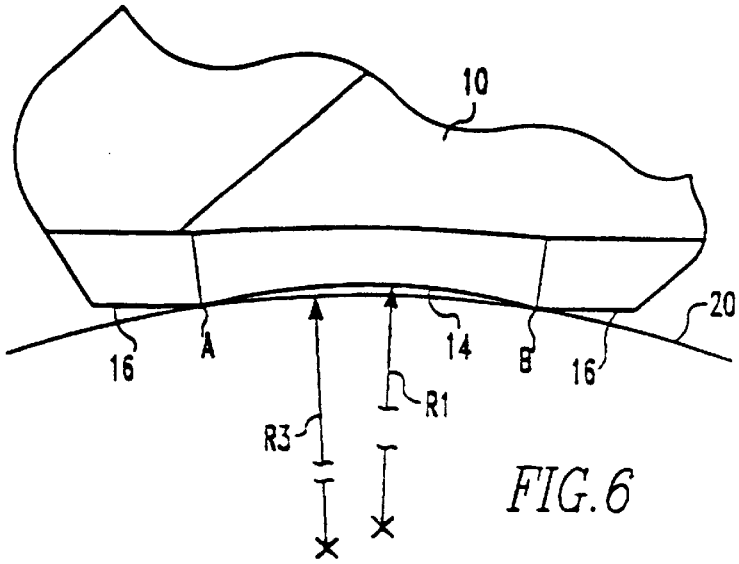
FIG. 6 illustrates a detailed view of the bit holder block invention resting on a rotary drum prior to welding.

FIG. 6 illustrates applicant's bit holder block 10 resting on a rotary drum 20 prior to welding. As can be seen in FIG. 6 the bottom surface of the bit holder block makes two uninterrupted lines of contact against the rotary drum as it rests upon the drum's surface, along both; line of contact "A" and along line of contact "B". The radius of curvature R1 of the central portion of the bottom surface is much less than the radius of curvature of rotary drum R3. Accordingly the arcuate surface of the bit holder bottom surface intersects the drum surface along two separate lines of contact. The two flat flanking surfaces 16 only tangentially contact the drum surface, one bottom flat flanking surface 16 tangentially contacts the drum along line of contact "B" and the other opposite flat flanking surface 16 tangentially contacts the drum along line "A". The two lines of contact ensure that no undesirable rocking of the bit holder/cutting tool assembly occurs about a single contact line during operations. Bit holder block assemblies in the prior art that are designed to have the same radius of curvature as the rotary drum they are affixed to in some instances when they were manufactured slightly out of tolerance would rock. This occurred because the radius of curvature of the bit holder bottom was imprecisely manufactured to be greater than the radius of curvature of the rotary drum resulting in a single line of contact between the bit holder block and drum.

The two lines of contact with the rotary drum in this invention prevent rocking and are sufficient for forming a sufficiently strong weld bond between the bit holder block and the rotary drum that withstands large loads.

Most rotary drums in industry can have diameters between 2'–10'(R3=1–'5') in diameter but generally have a diameter within the range of 3'–8' (feet). Accordingly the preferred radius of curvature R1 of the central portion of the bottom face of applicant's invention is 10" (20 inches in diameter). With a radius of curvature R1 of 10" applicant's bit holder block can effectively be affixed to nearly all drum cutting machines contacting the drums only along two lines of contact. The radius of curvature R1 of the central portion for the larger drums can be closer to 4 feet in diameter and for much smaller diameter drums can have a radius of curvature between 2"–12". In every rotary drum and bit holder support block assembly the ratio of radius of curvature between the radius of the bottom surface of the block and the radius of the drum, R1/R3 must be less than 1:1 to prevent undesirable rocking.

Figure 7:
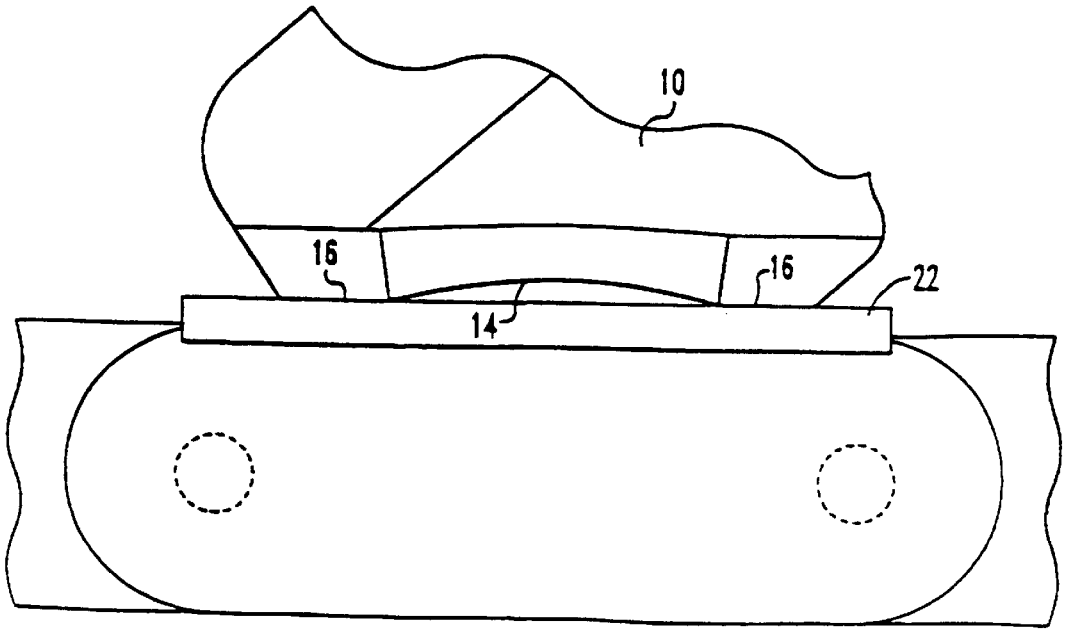
FIG. 7 illustrates a detailed view of the bit holder block invention resting on a chain driven plate prior to welding.
Figure 8:
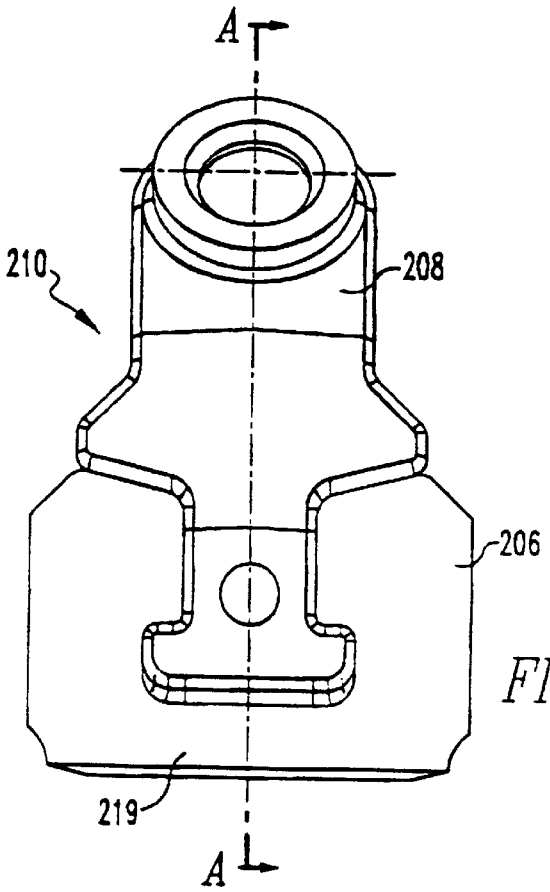
FIG. 8 illustrates a second embodiment of the invention in which the bit holder comprises a bit holder block assembly.

In FIG. 7 a detailed illustration of applicant's bit holder block is shown resting on a conventional flat plate 22 of a chain driven cutting machine. As can be seen in FIG. 8 both flat flanking portions 16 of the bottom surface of the bit holder block each make planar surface to surface contact with flat plate 22. The only portion of the bottom surface of the bit holder block that is not in contact with the chain plate 22 is the curved central portion 14. The flat surface to surface contact between the bottom of the bit holder block and the chain plate prevents rocking and that adequately permits the bit holder block to be welded to the chain plate to prevent the bit holder block from being ripped off by abnormally high loads that may occur during mining and construction.

Figure 10:
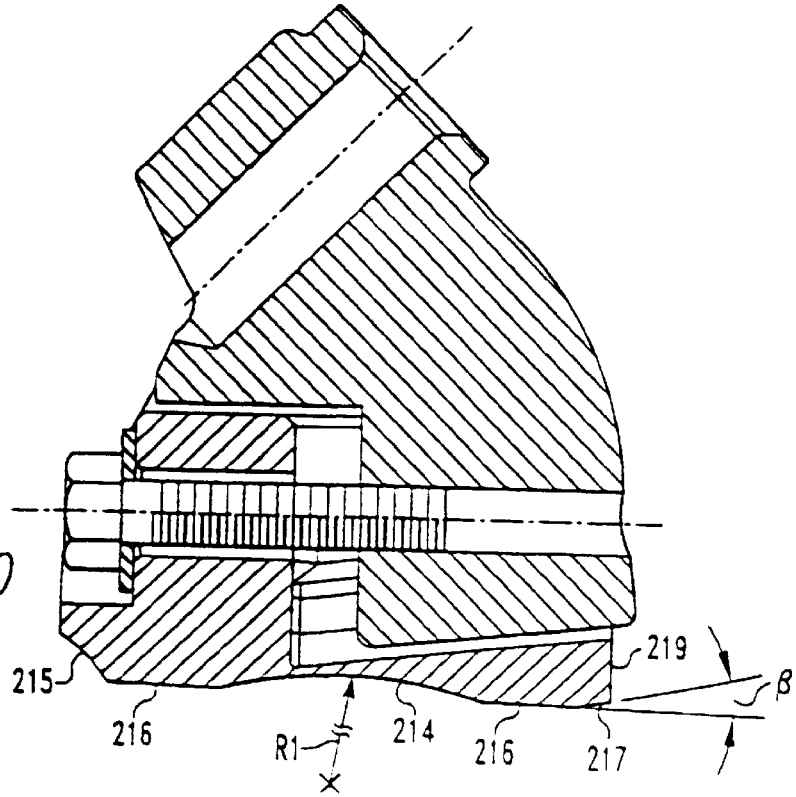
FIG. 10 shows a cross section along lines A—A of the bit holder block assembly shown in FIG. 8.
Figure 9:
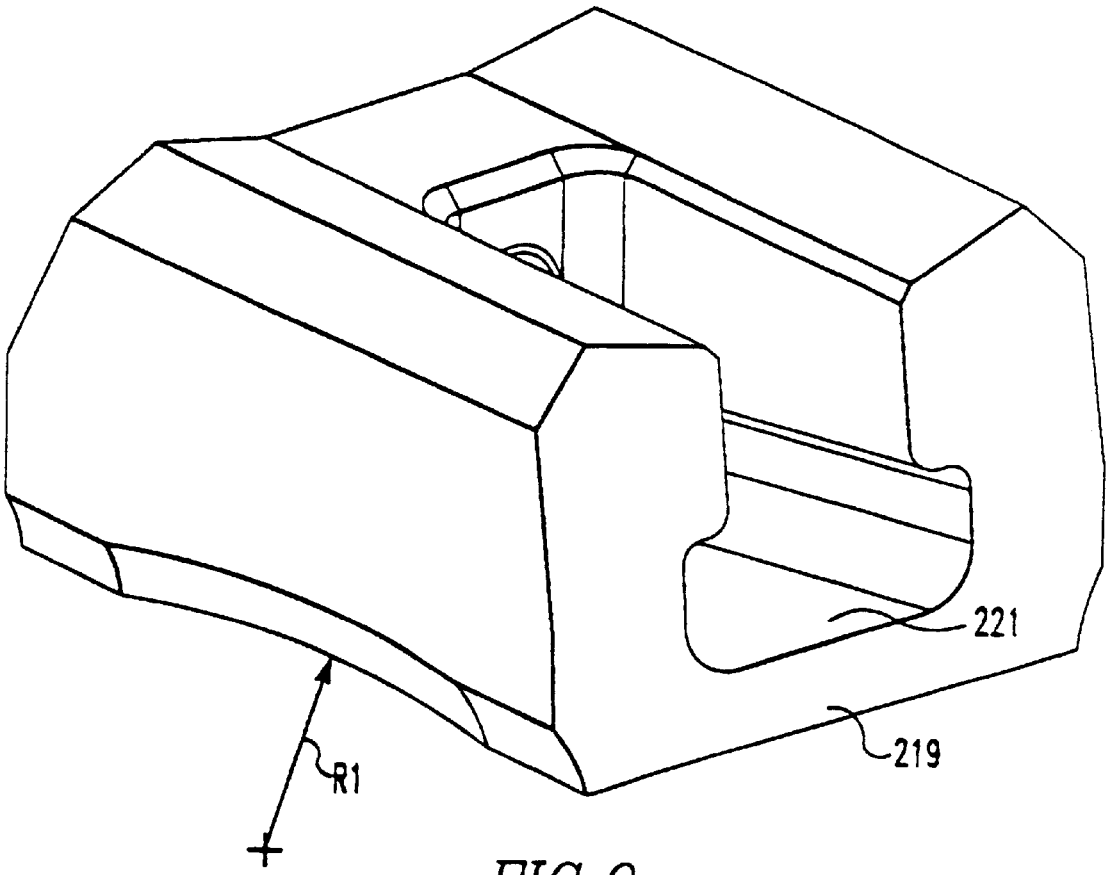
FIG. 9 illustrates the base portion of the bit holder block assembly shown in FIG. 8.

In FIGS. 8–10 a second embodiment of the invention is shown. The bit holder block 210 in this embodiment is assembled from two separate members a base member 206 and holder member 208. The base member 206 can be welded to either a rotary or driven chain as the first embodiment. As seen in FIG. 10 the bottom surface includes a centrally curved center portion 214 and two flanking adjacent portions 216. Wherein the flanking adjacent portions are flat and coplanar, and the centrally curved portion 16 has a radius of curvature R1.

In prior art designs section 217 was also chamfered at 45 degrees as the rest of the circumference of the block. The chamfer is for the purpose of enchancing welding of the support block base to a drum or chain. Thermal cracking occurs regularly on or near the front face of the support block base between the chamfered section and the bottom of the T-slot groove in the prior art design. The thermal cracking occurs on account of the inability of the material to properly dissipate temperatures and heat associated with welding.

The one adjacent flanking portion surface 216 shown in FIG. 10 ends at diverging upwardly chamfer 215 near the rear of the tool at an angle of approximately 45 degrees. The adjacent flat flanking portion 216 at the forward end of the tool is contiguous with an upwardly tapered surface that makes an angle B with respect to the adjacent flat flanking horizontal portion as seen in FIG. 10. The tapered surface diverges at an angle B across the entire width of the front side end of the base. The tapered angle B is between 3–12 degrees. As a result the tapered bottom portion 217 does not slope as far upward and close to the T-slot groove as for instance a chamfered surface at 45 degrees. The front face portion 219 immediately below the bottom of the T-slot groove extends much closer to the bottom plane of the bit holder assembly than the remaining side faces. The expanded breadth of material on the front end of the block better helps to dissipate the heat applied to the block during welding.

Additionally base member 216 has at the corners where two sides converge, weld dams are positioned at corners to prevent weld defects and improve the integrity of the weld. Commonly assigned U.S. Pat. application No. 09/298,105 to Michael C. Mondy filed on Apr. 22, 1999, titled "WELD JOINT DESIGN FOR CORNERS" is hereby incorporated by reference.

What is claimed is:

1. An earth working bit holder block for being fastened to either an arcuate surface or flat surface comprising (a) a bottom surface wherein said bottom surface has a curved central portion and a first flanking portion adjacent one end of the curved central portion and a second flanking portion adjacent an opposite end of said curved central portion, wherein said first flanking portion and said second flanking portion are flat substantially coplanar surfaces.

2. An earth working bit holder block for mounting a cutting bit tool comprising (a) a bottom surface wherein said bottom surface has a curved central portion and a first flanking portion adjacent one end of the curved central portion and a second flanking portion adjacent an opposite end of said curved central portion, wherein said first flanking portion and said second flanking portion are flat substantially coplanar surfaces.

3. The bit holder block according to claim 1 wherein said curved central portion is arcuate.

4. The bit holder block according to claim 3 wherein said arcuate central portion has a radius of curvature less than or equal to 4 feet.

5. The bit holder block according claim 3 wherein said arcuate central portion has a radius of curvature greater than 2 inches.

6. The bit holder block according to claim 3 wherein said arcuate central portion has a radius of curvature of between 2 inches–12 inches.

7. A rotary cutting drum comprising:

a bit holder block having a bottom surface connected to said drum wherein said bottom surface has a curved central portion and a flanking portion adjacent the curved central portion and a second flanking portion adjacent an opposite end of said curved central portion, wherein said first flanking portions are flat substantially coplanar faces.

8. The rotary cutting drum according claim 7 wherein said bottom surface of said bit holder block forms two lines of contact with said drum when the bit holder block rests in position said drum.

9. The rotary cutting drum according to claim 7 wherein said drum's radius of curvature R3 and said arcuate portion of said bottom surface has a radius of curvature R1, the ratio of radius of curvature between the radius of the bottom surface and the radius of the drum, R1/R3 is less than 1:1.

10. The rotary cutting drum according to claim 7 wherein said arcuate central portion has a radius of curvature of between 2 inches–12 inches.

11. A driven chain comprising:

a bit holder block having a bottom surface connected to said chain wherein said bottom surface has a curved central portion and a first flanking portion adjacent the curved central portion and a second flanking portion adjacent an opposite end of said curved central portion, wherein said first flanking portion and said second flanking portions are flat substantially coplanar surfaces.

12. The driven chain according to claim 11, wherein said driven chain includes a substantially planar flat plate, both said first flanking portion and said second flanking portion make substantially planar to planar contact with said flat plate.

* * * * *